US006580202B1

(12) United States Patent
Pollner

(10) Patent No.: US 6,580,202 B1
(45) Date of Patent: Jun. 17, 2003

(54) ELECTRICALLY CONDUCTIVE SEALING MASS FOR SPARK PLUGS

(75) Inventor: Rudolf Pollner, Bamberg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/856,204

(22) PCT Filed: Nov. 13, 1999

(86) PCT No.: PCT/DE99/03622

§ 371 (c)(1),
(2), (4) Date: May 18, 2001

(87) PCT Pub. No.: WO00/31843

PCT Pub. Date: Jun. 2, 2000

(30) Foreign Application Priority Data

Nov. 23, 1998 (DE) ..... 198 53 844

(51) Int. Cl.[7] ..... H01T 13/36
(52) U.S. Cl. ..... 313/145; 313/144; 313/143
(58) Field of Search ..... 313/11.5, 141, 313/142, 136, 145; 123/169 E, 169 EL

(56) References Cited

U.S. PATENT DOCUMENTS 4,400,643 A 8/1983 Nishio et al. ..... 313/11.5
4,414,483 A 11/1983 Nishio et al. ..... 313/136
5,310,373 A * 5/1994 Treiber et al. ..... 445/7

FOREIGN PATENT DOCUMENTS

DE 22 45 403 A 3/1974

* cited by examiner

*Primary Examiner*—Ashok Patel
*Assistant Examiner*—Jason Phinney
(74) *Attorney, Agent, or Firm*—Michael J. Striker

(57) ABSTRACT

A spark plug with a metallic housing (10) is proposed, which has an insulator (11) embedded in the housing (10), in which a rod-shaped internal conductor device is disposed. The internal conductor device has a contact pin (13), a current-limiting erosion resistor (17), and a central electrode (14). A sealing material (16) secures the central electrode (14) in a sealed fashion in the insulator (11). The temperature resistant sealing material (16) essentially contains at least one metallic component and at least one ceramic component with a low thermal expansion, wherein the metallic component has a melting temperature that is higher than the operating temperature.

6 Claims, 3 Drawing Sheets

ELECTRICALLY CONDUCTIVE SEALING MASS FOR SPARK PLUGS

BACKGROUND OF THE INVENTION

The invention relates to a spark plug. Sealing materials are used for tightly fusing a central electrode into an insulator of the spark plug.

A spark plug of the type that defines the species is known, for example, from DE 22 45 403 in which the sealing material for tightly fixing the central electrode in the insulator is comprised of a mixture of a glass as a meltable component and graphite and/or powdered carbon black as an electrically conductive component. Moreover, it is also known to use copper or iron as conductive powdered materials. When the mixture in the insulator is melted, the glass softens as a result of which a contact pin and a central electrode become embedded in the insulator upon fusing. The thermal stability of the fusing, however, is limited because the glass is only sufficiently low viscosity for the fusing at temperatures far above the transformation temperature, while the application limit for the fusing is limited by the transformation temperature of the glass (softening of the fusing, decomposition of the fusing by means of ion transport in the electrical field).

SUMMARY OF THE INVENTION

Has the advantage that the sealing material has a higher thermal stability. The proposed metal-ceramic sealing material has a definite melting point and a narrow melting interval, as a result of which the sealing material can be loaded until just below the melting temperature of the metal used. As a result, the distance between the temperature of the fusing and the operating temperature is considerably reduced. This also permits the sealing material to be used in the vicinity of the tip of the insulator base. As a result, it is possible to use the sealing material for nail-shaped platinum electrodes, which have only a slight axial expansion at the tip of the insulator base.

A particularly temperature stable sealing material is achieved if the metallic component is 20 to 40 volume % and the ceramic component is 60 to 80 volume %.

BRIEF DESCRIPTION OF THE DRAWINGS

Three exemplary embodiments of the invention are shown in the drawings and will be described in detail in the subsequent description.

DESCRIPTION OF THE PREFERRED EMBODIMENTS

Figure 1:
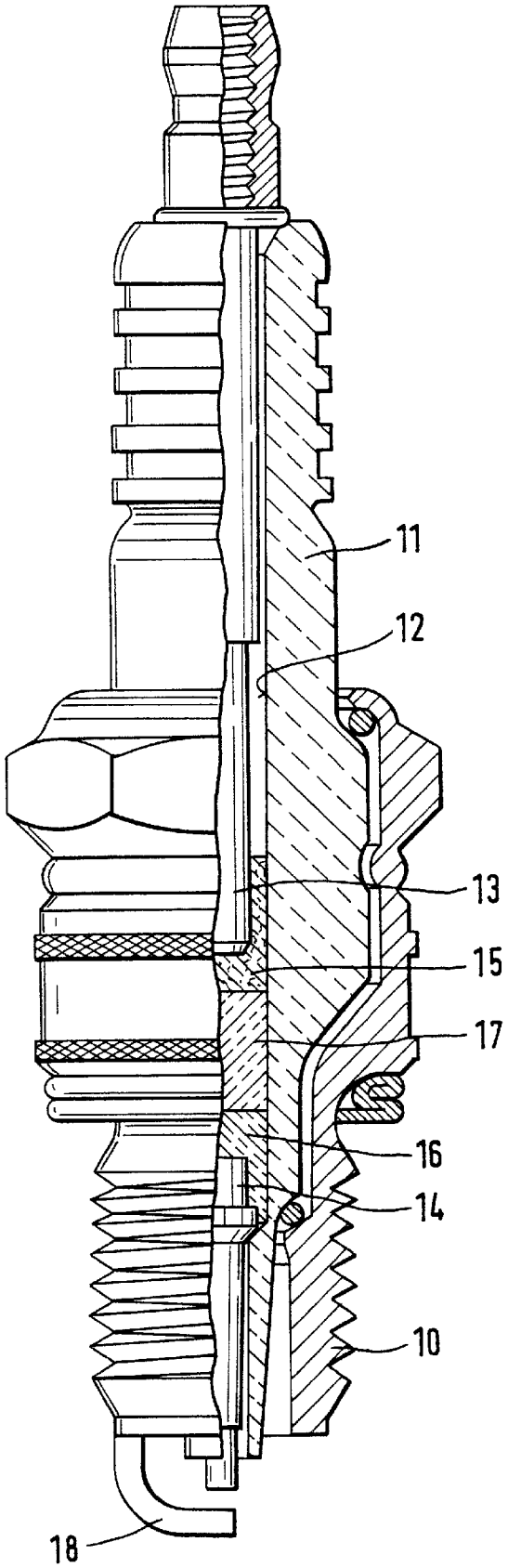
FIG. 1 is a sectional depiction of a spark plug.

The spark plug shown in FIG. 1 is comprised of an insulator 11, which is crimped in a gas-tight manner into a metallic housing 10, wherein the rotationally symmetrical axes of the housing 10 and the insulator 11 are congruent. The insulator 11 has an insulator bore 12 in which are disposed an internal conductor device with a contact pin 13, a connection-end contact packet 15, an erosion resistor 17, a temperature resistant sealing material 16, and a central electrode 14. A ground electrode 18 is also embodied on the housing 10. The central electrode 14 and the ground electrode 18 protrude into a combustion chamber that is not shown.

The sealing material 16 and the contact packet 15 have the task of sealing the erosion resistor 17 against the penetration of oxygen during the fusing process and during operation of the spark plug. The contact packet 15 also has the task of fixing the contact pin 13 in the insulator bore 12. In addition to the sealing action, the sealing material 16 has the same task in relation to the central electrode 14. Due to its proximity to the combustion chamber, the sealing material 16 is subjected to a significantly higher thermal load than the contact packet 15.

In order to assure the appropriate thermal stability, the sealing material is essentially comprised of a metallic component and a ceramic component. The metallic component is comprised of at least one metal powder and/or at least one powder of a metal alloy, wherein the melting temperature of the metallic component is above the operating temperature of the spark plug of 900° C., for example. In order to not thermally overload the spark plug during the fusing of the sealing material 16, it is logical if the melting temperature of the metallic component is below 1000° C. A ceramic powder with a low thermal expansion is suitable as the ceramic component, for example mullite, sillimanite, AlN, $Si_3N_4$, silica glass, or similar ceramic materials, or a mixture of these materials.

A mixture of 30 volume % tin bronze powder and 7.0 volume % mullite has turned out to be a suitable composition of the sealing material 16 which, with a thermal expansion coefficient of $8.4*10^{-6}$ $K^1$, for example, is largely adapted to the thermal expansion coefficient of the insulator. In order to improve the adhesion of the metal phase to the ceramic filler, an active solder, e.g. AgTi solder, can be used as the metallic component.

Figure 2:
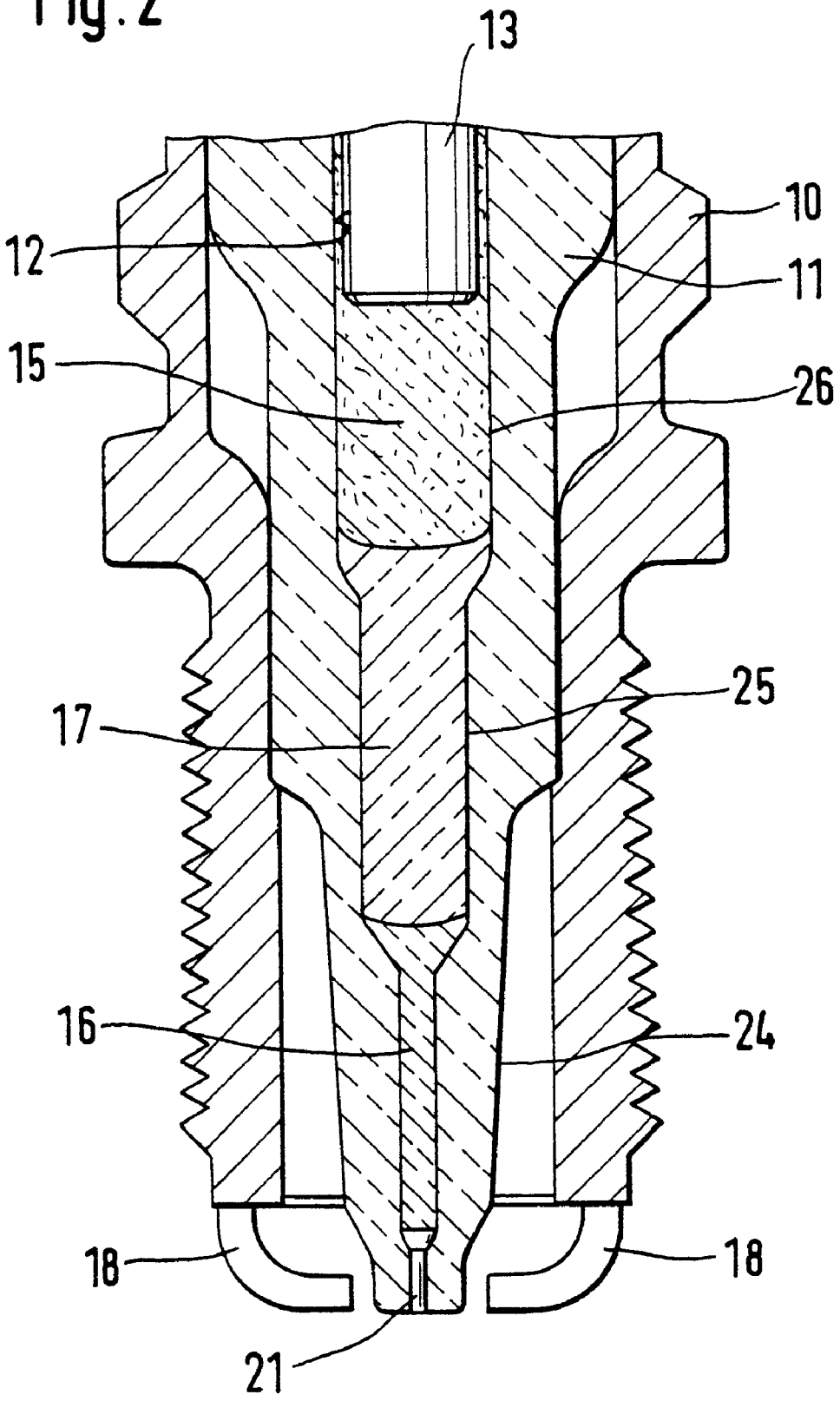
FIG. 2 shows the combustion chamber end of a second embodiment of the spark plug.

A second exemplary embodiment of the spark plug can be inferred from FIG. 2. This embodiment uses a nail-shaped platinum electrode 21, which is for example sintered into the insulator 11. The platinum electrode 21 cooperates, for example, with 2 or 4 ground electrodes 22. In this embodiment, the insulator bore 12 is embodied as stepped. Starting from the platinum electrode 21, a first bore section 24, a second bore section 25, and a third bore section 26 are embodied one after the other, wherein the diameter of the first bore section 24 is smaller than the bore diameter of the second bore section 25, and the diameter of the third bore section 26 is greater than the diameter of the second bore section 25. In the exemplary embodiment according to FIG. 2, the contact pin 13 and the contact packet 15 are disposed in the third bore section 26. At the end oriented toward the combustion chamber, the contact packet 15 is adjoined by the erosion resistor 17, which extends essentially inside the second bore section 25. The sealing material 16 is disposed between the erosion resistor 17 and the platinum electrode 21, and consequently is disposed inside the first bore section 24. The sealing material 16 has the composition described in the first exemplary embodiment.

Figure 3:
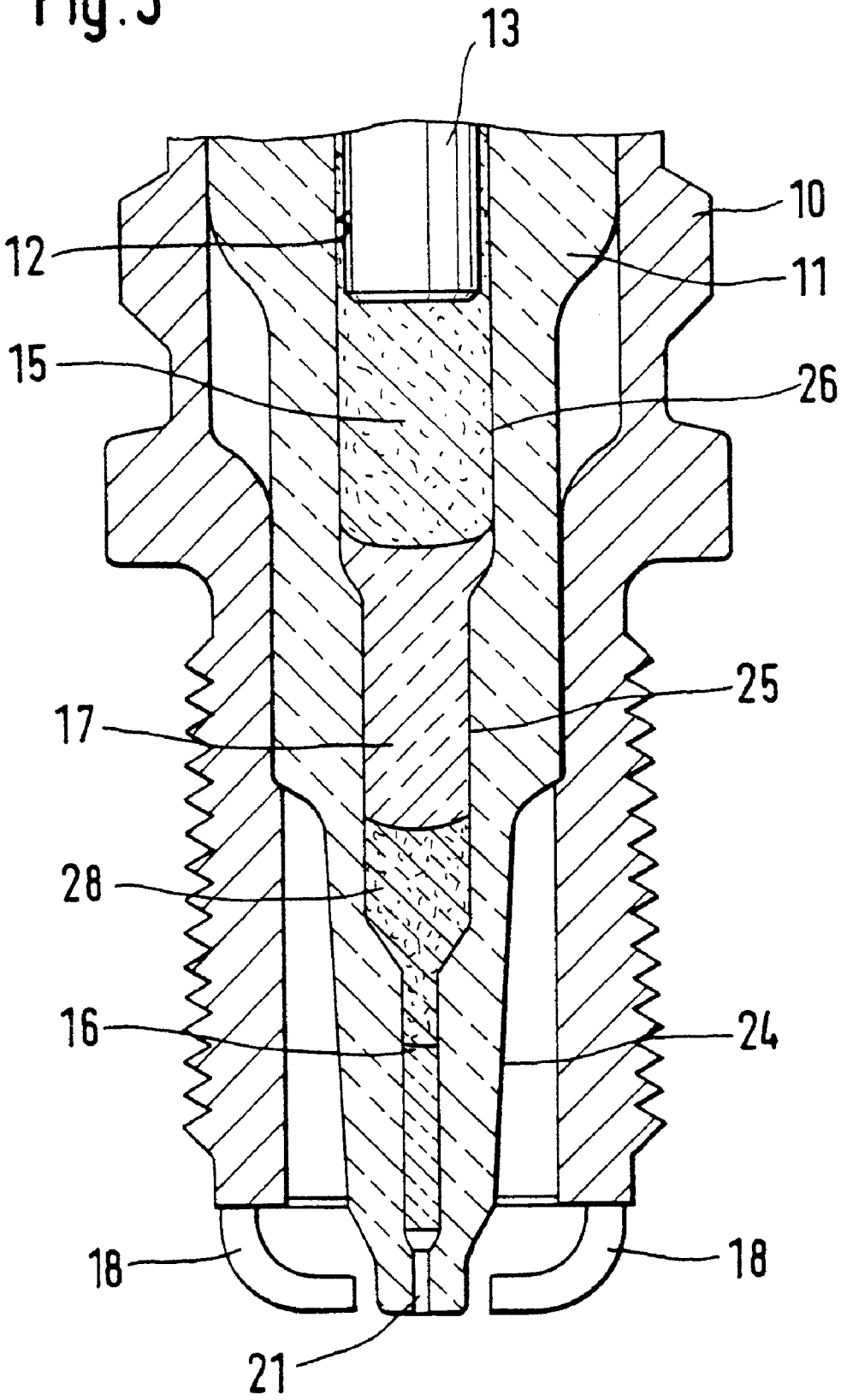
FIG. 3 shows the combustion chamber end of a third embodiment of the spark plug.

A third exemplary embodiment of a spark plug can be inferred from FIG. 3 in which, by contrast with the embodiment according to FIG. 2, an additional electrically conductive contact packet 28 is disposed between the erosion resistor 17 and the sealing material 16. The contact packet 28 extends, for example, from the second bore section 25 into the third bore section 26. However, it can also assume any other position; the only thing that must be assured is that the erosion resistor 17 and the sealing material 16 retain their function. The additional contact packet 28, which is preceded by the sealing material 17 viewed from the combustion chamber, does not thereby have to possess the high thermal stability of the sealing material 16. Therefore the additional contact packet 28 can be comprised of a composition which corresponds, for example, to the composition of the contact packet 15 oriented toward the connection end. Compositions of this kind are, for example, a mixture of glass and graphite and/or carbon black, wherein small amounts of powdered aluminum can be contained in the mixture.

What is claimed is:

1. A spark plug, comprising a metallic housing; an insulator embedded in said housing; a rod-shaped internal conductive device disposed in said insulator, said conductor device having a contact pin, a current-limiting erosion resistor, and a central electrode, said central electrode being fused in said insulator by a temperature resistant sealing material, said sealing material essentially containing at least one metallic component and at least one ceramic component with a low thermal expansion, said metallic component having a melting temperature that is higher than an operating temperature and lower than 1000° C., wherein said metallic component is 20–40 volume percent, and said ceramic component is 60–80 volume percent.

2. A spark plug as defined in claim 1, wherein said metallic component is composed of a material selected from a group consisting of at least one metal, at least one metal alloy, and both.

3. A spark plug as defined in claim 1, wherein said metallic component is a material selected from the group consisting of tin bronze, and active solder, and a mixture of both.

4. A spark plug as defined in claim 3, wherein said active solder is an AgTi solder.

5. A spark plug as defined in claim 1, wherein said ceramic component is a material selected from the group consisting of mullite, sillimanite, AlN, $Si_3N_4$, sillicaglass, and a mixture of these materials.

6. A spark plug as defined in claim 1, wherein said sealing material has a thermal expansion coefficient which is adjustable by a composition ratio of said metallic component and said ceramic component.

* * * * *